US006732564B2

(12) United States Patent
Runk et al.

(10) Patent No.: US 6,732,564 B2
(45) Date of Patent: May 11, 2004

(54) PRESS BRAKE TOOL AND TOOL HOLDER

(75) Inventors: David M. Runk, St. Joseph, WI (US); Glen M. Shuldes, Shoreview, MN (US); Heath E. Harrington, Coon Rapids, MN (US)

(73) Assignee: Wila B.V., Lochem (NL)

( * ) Notice: Subject to any disclaimer, the term of this patent is extended or adjusted under 35 U.S.C. 154(b) by 41 days.

(21) Appl. No.: 10/194,774

(22) Filed: Jul. 11, 2002

(65) Prior Publication Data

US 2003/0033846 A1 Feb. 20, 2003

Related U.S. Application Data

(63) Continuation of application No. 09/930,546, filed on Aug. 15, 2001.

(51) Int. Cl.[7] ..... B21D 37/04; B21D 5/02

(52) U.S. Cl. ..... 72/481.1; 72/389.3; 72/389.9; 72/482.6; 72/482.91; 72/482.92

(58) Field of Search ..... 72/389.3, 481.1, 72/481.6, 482.2, 482.6, 482.91, 482.92

(56) References Cited

U.S. PATENT DOCUMENTS

| | | | | | |
|---|---|---|---|---|---|
| 3,779,122 | A | | 12/1973 | Sawvell | 83/698 |
| 4,787,237 | A | | 11/1988 | Houston et al. | 72/462 |
| 5,009,098 | A | | 4/1991 | van Merksteijn | 72/389 |
| 5,042,352 | A | | 8/1991 | Lux | 83/690 |
| 5,245,854 | A | * | 9/1993 | Bruggink et al. | 72/481.7 |
| 5,460,027 | A | * | 10/1995 | Takahashi | 72/482.91 |
| 5,642,642 | A | * | 7/1997 | Kawano | 72/482.91 |
| 5,782,308 | A | * | 7/1998 | Latten et al. | 72/481.6 |
| 5,794,486 | A | | 8/1998 | Sugimoto et al. | 72/481.1 |
| 6,003,360 | A | | 12/1999 | Runk et al. | 72/482.2 |
| 6,467,327 | B1 | * | 10/2002 | Runk et al. | 72/481.1 |

FOREIGN PATENT DOCUMENTS

| | | |
|---|---|---|
| DE | 31 36 440.3 | 3/1983 |
| EP | 0 119 108 | 9/1984 |
| EP | 0 237 800 | 9/1987 |
| EP | 0 256 245 | 2/1988 |
| EP | 0494714 | 1/1992 |
| EP | 0767015 | 9/1996 |
| FR | 2122977 | 9/1972 |
| FR | 2 416 064 | 2/1978 |
| FR | 2 598 946 | 11/1987 |
| JP | 9100034 | 12/1982 |
| JP | 57089929 | 12/1982 |
| SU | 741999 | 11/1977 |

* cited by examiner

*Primary Examiner*—David B. Jones
(74) *Attorney, Agent, or Firm*—Webb Ziesenheim Logsdon Orkin & Hanson, P.C.

(57) ABSTRACT

An American style press brake tool and tool holder having a safety key. The holder has a body with walls defining a downwardly open, tool receiving recess having a top, a downwardly facing force-delivering shoulder adjacent the bottom of said recess, and a shelf within said recess having an upwardly facing surface spaced upwardly from said force-delivering shoulder. The tool comprises a body having a lower work-engaging surface, an upwardly facing force-receiving shoulder engageable with the shoulder of the tool holder, and an upwardly extending tang receivable in said recess, the upper end of the tang being spaced from the top of the recess. A manually operable actuator is spaced below said force-receiving shoulder, and a safety key is coupled to the actuator for movement horizontally into and out of alignment with the shelf between locked and unlocked positions, respectively.

7 Claims, 3 Drawing Sheets

PRESS BRAKE TOOL AND TOOL HOLDER

This is a continuation of application Ser. No. 09/930,546 filed Aug. 15, 2001.

FIELD OF THE INVENTION

The invention relates to a press brake tool holder and a tool commonly referred to as "American-style" tooling.

BACKGROUND OF THE INVENTION

Press brakes commonly are equipped with a lower table and an upper table, one of which, commonly the upper table, is vertically movable toward the other table. Forming tools are mounted to the tables so that when the tables are brought together, a workpiece between the forming tables is bent into an appropriate shape. It is common for the upper table to include a male forming tool having a bottom workpiece-deforming surface, usually V shaped, and for the bottom table to have an appropriately shaped die having an upper surface vertically aligned with the workpiece deforming surface of the tool so that when the tool and die are brought together, a workpiece between the two is pressed by the forming tool into the die and thus is given an appropriate bent shape.

It often is necessary to exchange forming tools and dies when a different bending operation is to be performed. The dies, commonly supported by the bottom table of a press brake, are readily removed and exchanged for others. However, the forming tools that usually are mounted to the upper table of a press brake often are not easily replaced. Forming tools usually are held by a C clamp or other holder to the horizontally elongated upper table. Once the clamp has been loosened, the forming tool can, in some instances, be removed downwardly, and in others, must be removed by horizontally sliding it from the clamp. If a long forming tool is to be replaced, it becomes difficult to slide the forming tool from its clamp because of the proximity of neighboring clamps and forming tools; these, in turn, may themselves have to be removed in order to complete the tool exchange process.

Because long forming tools can be quite heavy, when a clamp is loosened to the point that the tool can be removed by moving it downwardly, a tool may accidentally slip and fall, causing harm to press brake operators and equipment.

An early press brake holder design is known as the "American style" and is shown schematically in FIG. 1A holding a common American-style press brake tool. As shown in this figure, the bottom edge portion of the upper table is so fashioned as to accept a clamp C, and a heavy bolt is employed to attach the clamp to the table. The press brake table and clamp respectively include generally parallel, facing surfaces defining a downwardly open recess into which the tang T of a press brake tool is received. The bottom surfaces B of the press brake table and clamp commonly are horizontally aligned, and serve as load bearing surfaces for transmitting a downwardly directed load onto the upwardly facing shoulders S of a press brake tool. To mount the tool in the holder, the tool is pushed upwardly until its load receiving surfaces S encounters the load transmitting surfaces B of the clamp and table, as depicted, and the bolt then is tightened to clamp the punch tool tang between the clamp and table.

From a manufacturing standpoint, the simplified design of the American-style press brake tooling requires that the upwardly facing shoulders be fairly accurately horizontally aligned, but the tolerances on the height of the tang of the tool are relatively wide. As a result, long sections of American-style tooling can be manufactured, and when a press brake operator needs a particular length of tooling, the appropriate length simply is cut from the long section and used directly. When the tool is to be removed from the holder, the clamp C is loosened and the tool, firmly gripped by the press brake operator, is withdrawn downwardly. To avoid the possibility of accidental dropping of the tools, which can be quite heavy in long lengths, a strap can be attached to the top of the tang with the edge of the strap extending into a groove in the holder. However, with this arrangement, the tool can be removed only by sliding it sideways from the holder or by disassembling the entire holder.

American-style tool holders thus are of a simple design having few moving parts, and are relatively easy to use. Of the various types of press brake tooling and tool holders available, the American style is the most widely used and remains a favorite.

FIG. 1B is a schematic side view of a press brake tool and tool holder commonly referred to as a "European" or "Promecam" style. The press brake tool itself has an upwardly extending tang T that is generally rectangular in cross section and that has a safety groove extending along its length. Below the safety groove, the tool has an outwardly extending, upwardly facing shoulder S, and the tool extends downwardly from that shoulder to its workpiece-encountering edge. European style tool holders commonly include a lip or edge that extends into the safety groove of the tool to restrain accidental dropping of the tool. As with American-style tooling, the downwardly directed force of the ram is directed against an upwardly facing shoulder or shoulders of the tool, rather than against the upper surface of the tang. Examples of European style tooling are shown in U.S. Pat. Nos. 6,003,360 (Runk et al.) and 5,794,486 (Sugimoto et al.).

A third style of tooling, commonly referred to as Wila style tooling, is shown in FIG. 1C. Reference also is made to U.S. Pat. No. 5,245,854 for a description of this type of tooling and tool holder. The tool holder includes one or more horizontally extending safety slots, and the tool itself includes a movable projection that, in use, extends outwardly from a side wall of the tool into the safety slot. The upper end of the tang T of this tool style extends into force-receiving contact with the tool holder; that is, the downward force of the upper table is transmitted directly to the upper surface of the tang.

European-style and Wila-style tool holders enable tools to be removed downwardly from the holders. Although these tool holders have provided some safety features to restrain a heavy tool from accidentally falling from the tool holder, no such system has been devised for the more popular American-style tooling and tool holders. It will be understood that when small tools are being employed, the risk of injury from dropping the tool is not great, whereas when longer and heavier lengths of tooling are used, the risk of injury resulting from a tool that unintentionally drops from the tool holder is substantially greater.

It would be valuable to provide tooling that would be adaptable for use in American-style press brake tool holders, but that yet would offer the ability to loosen the clamp on the American-style tool holder without risking immediate dropping of the tool.

SUMMARY OF THE INVENTION

We have noted that, in American-style press brake tool holders, there exists, in the downwardly open recess receiving the tool tangs, a shelf having an upwardly facing surface, and we have devised a tool having a safety key that can engage the upper surface of the shelf to restrain the tool from unintentional dropping when the clamp is loosened, while not interfering with the transfer of a downwardly directed force from the upper table to the tool.

The present invention provides, in combination, a press brake tool and an American-style press brake tool holder from which the tool can be removed vertically rather than requiring the tool to be slid horizontally from the holder. The holder has a body with walls defining a downwardly open, tool-receiving recess having a top, a downwardly facing, force-delivering shoulder adjacent the bottom of the recess, and a shelf within the recess having an upwardly facing surface that is spaced upwardly from the force-delivering shoulder. The tool comprises a body having a lower, work-engaging surface, an upwardly facing, force-receiving shoulder that is engageable with the shoulder of the tool holder, and an upwardly extending tang that is receivable in the recess and that has an upper end that is spaced from the top of the recess. The tool includes a manually operable actuator that is spaced below the force-receiving shoulder of the tool so that it may be accessed and manually operated by a worker, and also a safety key that is operatively coupled to the actuator. The safety key has a lower surface that is spaced above the upper end of the tang and that is engageable with the upwardly facing surface of the shelf. The key is movable horizontally into and out of vertical alignment with the shelf between locked and unlocked positions, respectively, in response to manual operation of the actuator. Thus, the current invention makes use of the shelf that is normally part of the American-style tool holder, and does so in a manner that provides a long-awaited safety solution to tool-dropping problems associated with this most popular press brake tool and tool holder combination involving release and removal of a tool downwardly from the tool holder rather than requiring removal by sliding the tool sideways in the tool holder.

DETAILED DESCRIPTION OF THE PREFERRED EMBODIMENT

Figure 1C:
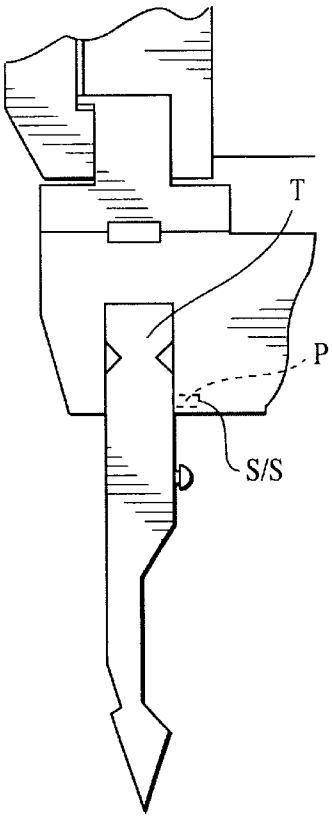
FIG. 1C is a schematic side view, partially broken away, of a Wila-style tool and tool holder.
Figure 1B:
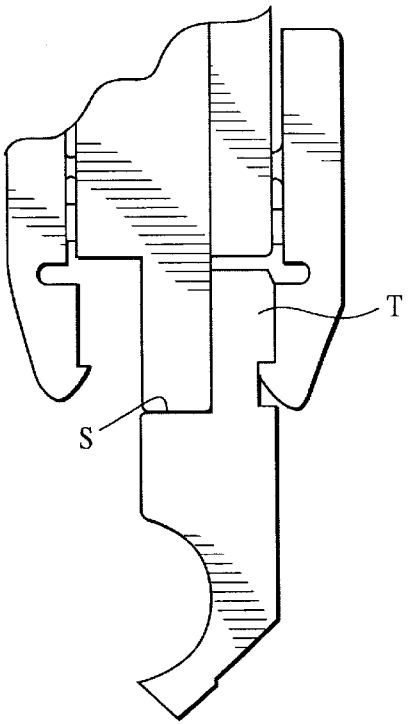
FIG. 1B is a schematic side view, partially broken away, of a tool and tool holder of the European style.
Figure 1A:
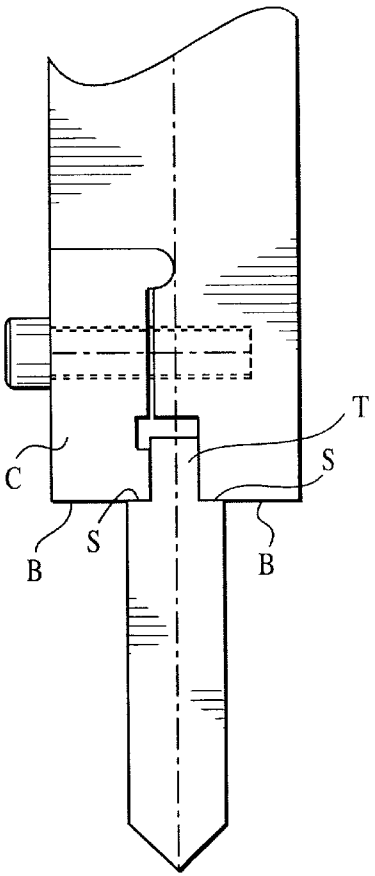
FIG. 1A is a schematic side view, partially broken away, of an American-style press brake tool and tool holder.
Figure 2:
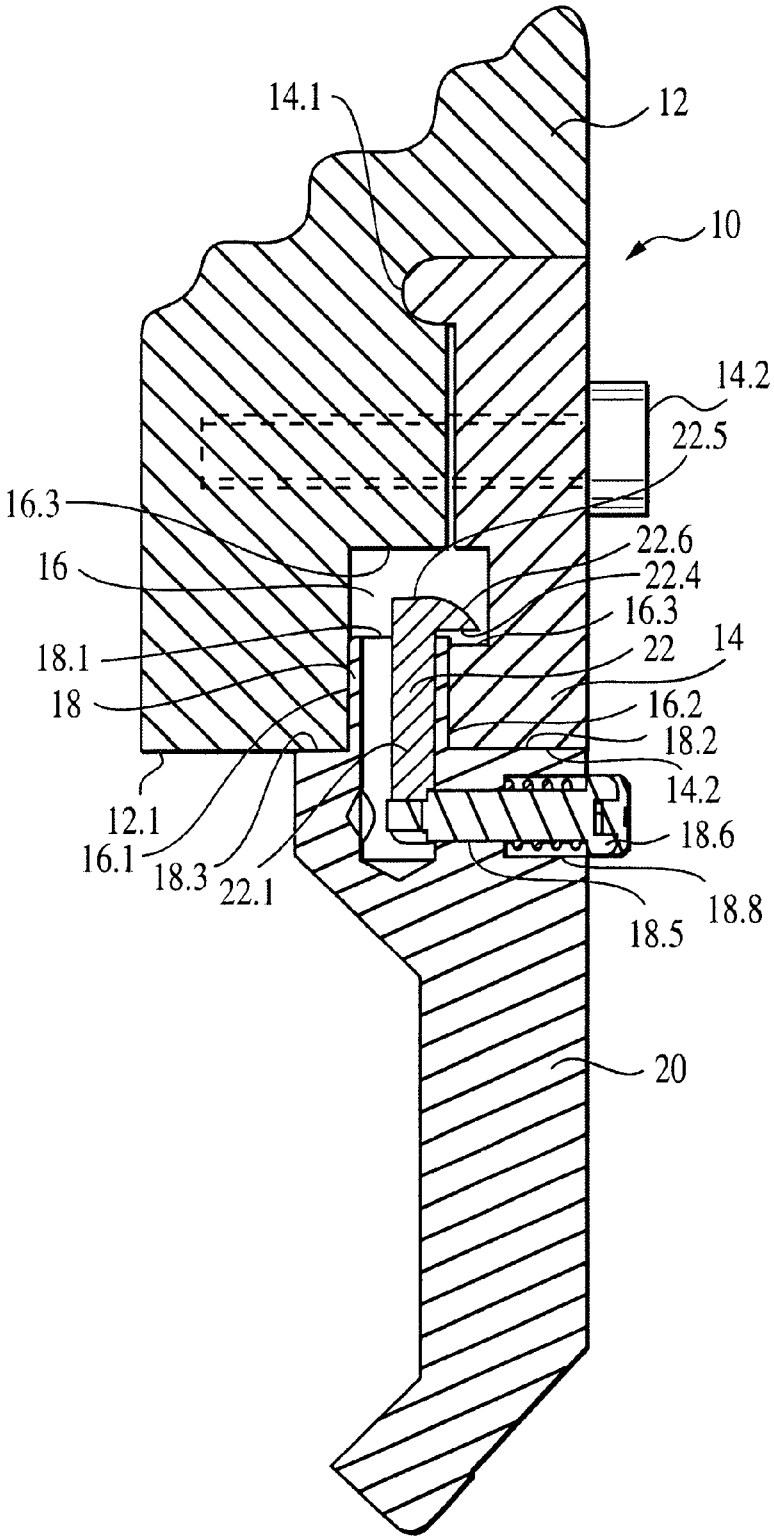
FIG. 2 is a broken-away, cross-sectional view showing the side of an embodiment of the invention.

FIG. 2 shows an American style press brake tool holder 10, the holder including the lower portion 12 of a press brake upper table and a clamp 14 that forms with the table portion a downwardly open recess 16. The clamp 14 is pivotally attached, as at 14.1, to the table portion. A bolt 14.2, normally accessible from the front side of a press brake, secures the clamp to the table portion.

The recess 16 includes parallel opposing walls 16.1, 16.2 for reception of the tang 18 of a press brake tool 20. Tang 18 has an upper end 18.1 that is spaced below the top 16.3 of the downwardly open recess 16, as depicted.

As noted above, the downwardly open recess of American style tool holders includes a shelf 16.3 offset slightly from that portion of the recess that receives the tang 18. The shelf 16.3 forms a shoulder that is generally upwardly facing and is spaced from the top 16.3 of the recess.

Figure 3:
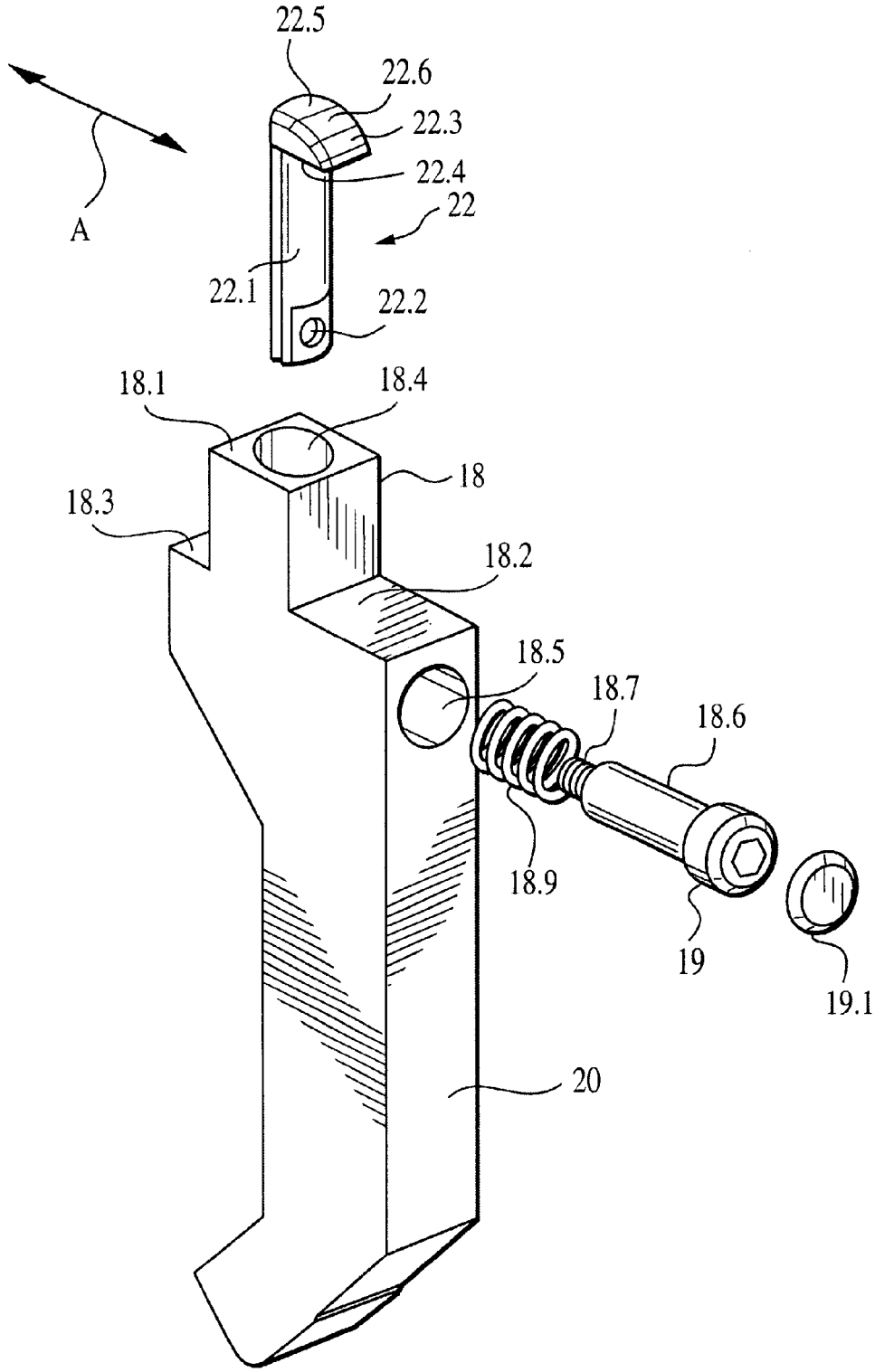
FIG. 3 is a perspective, exploded view showing a tool of the invention.

Referring now to FIG. 3, the press brake tool 20 employed in the present invention includes a body having at least one upwardly facing shoulder 18.2 on one side of the tang, and preferably a similar, horizontally aligned shoulder 18.3 on the other side. These upwardly facing, force receiving shoulders come into force transmitting contact with the force delivering shoulders 14.2, 12.1, respectively, of the clamp 14 and upper table portion 12 adjacent the entry to the downwardly open recess 16. As the table descends in a bending operation, the shoulders 18.2, 12.1 deliver a downwardly directed force onto the force receiving shoulders 18.2, 18.3, respectively, of the tool.

As shown in FIGS. 2 and 3, the press brake tool 20 of the invention includes a safety key shown generally as 22. This key includes a shank 22.1 that extends downwardly through a vertical bore 18.4 formed in the tang 18, the bore and the shank being so dimensioned as to enable to shank to have room for freedom of movement within the bore in the direction shown by the arrow A in FIG. 3, that is, in a horizontal direction. The tool includes also a horizontal bore 18.5 shaped to receive an actuator plunger 18.6, the latter having a threaded distal end 18.7 configured to thread in to the threaded hole 22.2 of the key 22. These elements are best seen with reference to FIG. 3. The bore 18.5 includes an outer, enlarged portion 18.8 (FIG. 2) forming a spring seat, and a helical spring 18.9 is received about the plunger 18.6 and is captured between the spring seat and the enlarged head 19 of the plunger.

The safety key and plunger mechanism are assembled as shown in FIG. 3. Following insertion of the shank 22.1 of the safety key downwardly into the bore 18.1, the plunger 18.6, with spring 18.9 carried about its circumference, is inserted into the bore 18.5 and is pushed distally until its threaded end 18.7 encounters the threaded hole 22.2 of the safety key. An Allen wrench or other tool is used then to thread the plunger into the hole 22.2 of the safety key, locking the safety key to the plunger. Note, in FIG. 2, that the confronting, generally vertical surfaces of the safety key (adjacent threaded hole 22.2) and plunger (adjacent its threaded end 18.7) come into surface-to-surface contact and thus rigidly lock the safety key to the plunger with the vertical axis of the safety key held at approximately a right angle with respect to the axis of the plunger. Finally, a decorative button 19.1 may be fastened to the outer end of the plunger as desired.

At its upper end, the safety key includes a protrusion 22.3 that extends generally horizontally over the shelf 16.3 of the downwardly open recess 16. To assure freedom of movement of the safety key, the bottom surface 22.4 (FIG. 2) is spaced above the upper end 18.1 of the tang and is so configured as to extend over the upper surface of the shelf 16.3.

Note may be taken that the safety key protrusion 22.3 has an upper surface 22.5 which, as it extends toward the end of the protrusion, tapers downwardly as shown at 22.6.

When the tool and tool holder are assembled, as shown in FIG. 2, the respective force transmitting shoulders of the tool holder and the force receiving shoulders of the tool are in contact with each other, thus limiting and defining the extent to which the tang 18 extends upwardly into the recess 16. As illustrated, the top of the tang 18.1 is spaced substantially beneath the top 16.3 of the recess. Moreover, the downwardly facing surface 22.4 of the safety key protrusion is at this point spaced above the upper end 18.1 of the tang and also the shelf 16.3. This necessary clearance enables the safety key 22 to be moved horizontally (to the left in FIG. 2) upon depression of the plunger 18.6 into the bore 18.5 against the spring pressure of the spring 18.9. When the safety key protrusion has been moved far enough to the left to vertically clear the shelf 16.3 (and assuming that the bolt 14.2 has been sufficiently loosened), the tool can be removed downwardly from the tool holder. Note also must be taken that the upper end 22.5 of the safety key is spaced beneath the top 16.3 of the recess.

Thus, to remove the tool from the tool holder, the bolt 14.2 is first loosened. This may enable the tool to slip downwardly slightly until the bottom surface of the safety key protrusion comes into contact with the shelf, preventing further downward movement of the tool. A workman then grasps the tool, lifts the tool upwardly slightly to space the bottom surface of the safety key protrusion above the shelf, and then pushes inwardly upon the plunger 18.6 to cause the safety key to move to the left in FIG. 2. The tool can thus be removed downwardly with a degree of safety. When a tool such as that shown in FIGS. 2 and 3 is to be remounted in the holder, the tool is pushed upwardly through the downwardly open recess 16. The downwardly tapered surface 22.6 of the safety key protrusion encounters the rim of the opening, and is cammed inwardly (to the left) slightly to enable the tang to be received in the recess. Preferably, the plunger 18.6 is depressed during this operation. Once the tang has been received in the recess, further upward movement of the tool causes the downwardly facing surface 22.4 of the safety key protrusion to horizontally clear the edge of the shelf 16.3, and as the safety key thus is freed to move to its locked position, and audible click commonly is heard. The elements, of course, are so dimensioned that the force transmitting and receiving shoulders of the holder and tool do not come into contact during upward motion of the tool into the holder until the safety key has sprung to its locked position by the spring 18.9, as shown in FIG. 2.

The relative dimensions of the tool and tool holder elements thus are of importance. For example, the vertical distance (x) between the force receiving surface of the tool to the lower surface of the safety key protrusion must be greater than the vertical distance (y) between the force delivering surface of the holder and the upwardly facing surface of the shelf 16.3. Desirably, the ratio x/y is not less than about 1.01, preferably is not less than about 1.03, and most preferably is in the range of about 1.01 to about 1.15. Moreover, the vertical distance (p) from the force receiving surface of the tool to the top of the tool holder recess must be greater than the distance (q) from the force receiving surface of the tool to the top surface 22.5 of the key. Desirably, the ratio p/q is greater than about 1.1 and preferably is in the range of about 1.1 to about 1.3. Further, the vertical distance (r) between the upper surface of the shelf and the top of the recess must be greater than the vertical distance (s) between the top and lower surfaces of the safety key protrusion. Desirably, the ratio r/s is at least about 1.7 and preferably is in the range of about 1.7 to about 2.4.

While a preferred embodiment of the present invention has been described, it should be understood that various changes, adaptations and modifications may be made therein without departing from the spirit of the invention and the scope of the appended claims.

What is claimed is:

1. In combination, a press brake tool and press brake tool holder, the holder having a body with walls defining a downwardly open, tool receiving recess having a top, a downwardly facing force-delivering shoulder adjacent the bottom of said recess, and a shelf within said recess having an upwardly facing surface spaced upwardly from said force-delivering shoulder, the tool comprising a body having a lower work-engaging surface, an upwardly facing force-receiving shoulder engageable with the shoulder of the tool holder, and an upwardly extending tang receivable in said recess, said tool having a manually operable actuator spaced below said force-receiving shoulder, and a safety key operatively coupled to said actuator, said key being movable horizontally into and out of said shelf between locked and unlocked positions, respectively, in response to manual operation of said actuator.

2. The press brake tool and tool holder of claim 1 so dimensioned that the ratio x/y is greater than about 1.01 in which x is the vertical distance from said force-receiving surface to a lower surface of said safety key, and y is the vertical distance between said force-delivering surface and the upwardly facing surface of said shelf.

3. The press brake tool and tool holder of claim 1 or claim 2 wherein said safety key has a top surface, said tool and holder being so dimensioned that the ratio p/q is greater than about 1.1 in which p is the distance from said force-receiving surface to said top of said recess, and q is the distance from said force-receiving surface to said top surface of said key.

4. The press brake tool and tool holder of claim 1 or claim 2 wherein said safety key has a top surface, and wherein said tool and holder are so dimensioned that the ratio r/s is greater than about 1.7 where r is the vertical distance between said top surface of the key and a lower surface of said key and s is the vertical distance between said upper surface of said shelf and said top of said recess.

5. The press brake tool and tool holder of claim 1 wherein said tool includes intersecting horizontal and vertical bores, and wherein said actuator comprises a horizontal shaft snuggly received in and slidable in said horizontal bore, and said safety key includes a vertical shaft movable horizontally in said vertical bore.

6. The press brake tool and tool holder of claim 5 wherein said actuator includes a spring positioned to be loaded when said activator is operated to move said safety key out of contact with said shelf.

7. The press brake tool and tool holder of claim 1 or claim 5 wherein said safety key includes a tapered camming surface adapted to contact said force delivering shoulder of said holder and to cam into its unlocked position as the tang of said tool is raised into said tool-receiving recess.

* * * * *